US005102117A

United States Patent [19]

Henn et al.

[11] Patent Number: 5,102,117

[45] Date of Patent: Apr. 7, 1992

[54] SHEET DELIVERY APPARATUS FOR ROTARY PRINTING PRESSES

[75] Inventors: Manfred Henn, Heidelberg; Carsten Kelm, Mannheim, both of Fed. Rep. of Germany

[73] Assignee: Heidelberger Druckmaschinen AG, Heidelberg, Fed. Rep. of Germany

[21] Appl. No.: 495,378

[22] Filed: Mar. 16, 1990

[30] Foreign Application Priority Data

Mar. 28, 1989 [DE] Fed. Rep. of Germany ... 8903802[U]

[51] Int. Cl.[5] ..... B65H 31/32

[52] U.S. Cl. ..... 271/189; 271/218

[58] Field of Search ..... 271/218, 189

[56] References Cited

U.S. PATENT DOCUMENTS

| | | | |
|---|---|---|---|
| 2,521,075 | 9/1950 | Matthews | 271/218 |
| 3,285,607 | 11/1966 | Lindemann | 271/218 |
| 3,966,192 | 6/1976 | Jeschke | 271/147 |
| 3,966,196 | 6/1976 | Simeth . | |
| 4,332,376 | 6/1982 | Volpe | 271/217 |
| 4,799,847 | 1/1989 | Boedewin . | |

FOREIGN PATENT DOCUMENTS

| | | | |
|---|---|---|---|
| 864400 | 1/1953 | Fed. Rep. of Germany | 271/218 |
| 3535113 | 4/1987 | Fed. Rep. of Germany . | |
| 48148 | 4/1980 | Japan | 271/218 |
| 2181116 | 4/1987 | United Kingdom . | |

*Primary Examiner*—Richard A. Schacher
*Attorney, Agent, or Firm*—Nils H. Ljungman & Associates

[57] ABSTRACT

Sheet delivery apparatus for rotary printing presses, in which the supplied sheets are deposited on a lowerable delivery table to form a pile of sheets. A bar grate is employed as a temporary storage apparatus and is adapted to be slid into position when a full pile of sheets, which are to be removed, are stacked. When the bar grate is slid into position, one end of it rests on a provided, laterally movable support.

20 Claims, 4 Drawing Sheets

SHEET DELIVERY APPARATUS FOR ROTARY PRINTING PRESSES

BACKGROUND OF THE INVENTION

1. Field of the Invention

The present invention relates to the sheet delivery mechanism provided on rotary printing presses, in which the supplied sheets of paper, cardstock, etc., are deposited on a lowerable delivery table to form a pile of sheets. A bar grate is employed as a temporary storage apparatus and is adapted to be slid into position when a full pile of sheets, which are to be removed, are stacked. When the bar grate is slid into position, one end of it rests on a provided, laterally movable, support.

2. Background Information

German Patent No. 35 35 113 relates to a sheet delivery apparatus having a lowerable support that performs the function of a bar grate. One disadvantage of the disclosed apparatus is that, for example, if Euro-pallets, which are larger than the maximum size of the sheets, are employed for stacking the paper, the support for the temporary storage apparatus, or bar grate, collides with the Euro-pallet when the Euro-pallet is raised. That impairs, considerably the operation of the bar grate. There is also the danger that the pile of delivered sheets, supported by the bar grate, will be damaged or displaced by the transport mechanism for the delivered sheets, resulting in additional difficulties and costs.

United Kingdom Patent Application No. 2 181 116 corresponds to, and claims priority from, German Patent Application No. 35 35 113.

OBJECT OF THE INVENTION

One object of the present invention is to provide a temporary storage apparatus, with a support for the bar grate, in which the support does not impair the operation of the sheet delivery mechanism.

SUMMARY OF THE INVENTION

That and other objects of the invention are achieved by providing the support in the form of a rail. The rail is held in such a manner that it is displaceable horizontally out of the area of the pile of sheets. If this design is used, for example, in non-stop operation with a pallet that corresponds to the size of the sheets, there is no risk of collision. If, however, the printer is forced to carry out certain printing jobs that have to be deposited on a Euro-pallet, and the machine is not working in non-stop operation, then the support is displaced out of the area of the pile of sheets and also out of the area of the pallet, so that the pile table can be raised into the uppermost end position without the pallet colliding with the support for the temporary-pile apparatus.

In a particularly advantageous embodiment of the invention, the means for horizontally displacing the support are disposed on either side of the rail and are in the form of pneumatic cylinders, with the rail being mounted on the piston rods of the pneumatic cylinders. That makes it possible, circuit-wise to link the displacing of the rail with the movement of the bar grate. Furthermore, the pneumatic cylinders are mounted on carriers and the carriers are lowerable as the height of the temporary pile of paper increases. This lowering of the temporary-pile apparatus is necessary, particularly, if processing thicker sheet stock in order to obtain an identical fall height for the sheets that are to be delivered.

One aspect of the invention resides broadly in a printing press that has sheet delivery apparatus for delivering sheets of paper or the like to the printing press, adjustable support apparatus for being positioned adjacent the sheet delivery apparatus, receiving apparatus for being positioned adjacent the sheet delivery apparatus for receiving delivered sheets and for accumulating the delivered sheets. The adjustable support apparatus is provided for supporting a temporary storage member. The temporary storage member is provided for the accumulation of the delivered sheets during the removal of accumulated sheets from the receiving apparatus. The adjustable support apparatus includes first support apparatus for supporting a first end of the temporary storage apparatus and apparatus for horizontally displacing the first support apparatus in a first direction beyond the horizontal extension of the accumulated sheets.

Another aspect of the invention resides broadly in an adjustable support apparatus for being positioned adjacent the sheet delivery area of a printing press. The printing press has receiving apparatus for receiving delivered sheets and for accumulating the delivered sheets of paper or the like. The adjustable support apparatus is provided for the support of a temporary storage member for the accumulation of the delivered sheets during the removal of accumulated sheets from the receiving apparatus. The adjustable support apparatus includes a first support member for supporting a first end of the temporary storage member and apparatus for horizontally displacing the first support member in a first direction beyond the horizontal extension of the accumulated sheets.

BRIEF DESCRIPTION OF THE DRAWINGS

The following detailed description of the preferred embodiments may be better understood when taken in conjunction with the appended drawings in which.

DESCRIPTION OF THE PREFERRED EMBODIMENTS

Figure 1:
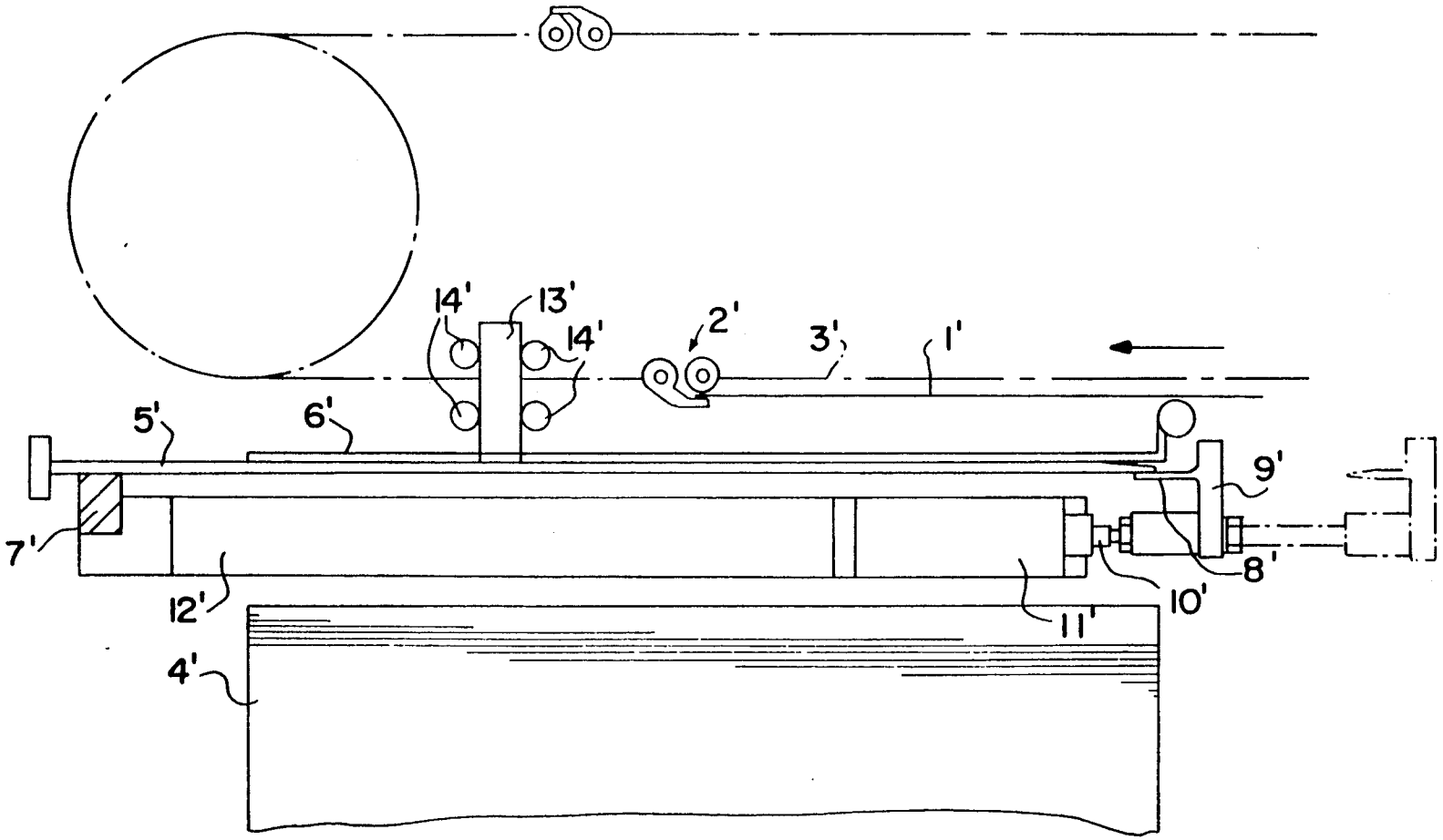
FIG. 1 is a side elevational view of the sheet delivery area of a rotary printing press employing a bar grate support device constructed according to the present invention.

In the sheet delivery area shown in FIG. 1, sheets 1', that are to be delivered, are supplied in known manner to a pile of sheets 4' by gripper bars 2', that are provided on chain system 3'. The pile of sheets 4' rests on a delivery table (not shown) that is lowerable according to the increasing height of the pile.

Such height adjustable delivery tables are well known in the arr, and examples of some may be found in U.S. Pat. No. 4,332,376, issued on June 1, 1982 to Volpe and entitled "Mechanism for Stacking Sequentially Received Sheets" and in U.S. Pat. No. 3,966,192, issued June 29, 1976 to Jeschke and entitled "Sheet Pile Elevator in Sheet Delivery Systems for Printing Machines." As soon as the pile of sheets 4' has reached an appropriate height, it is taken out of the machine, an empty pile board is inserted and the empty pile board is moved into its upper starting position to accept a new pile of sheets.

Referring to FIG. 1, for the time required for changing the pile board, a temporary pile 6' is formed on an insertable bar grate 5'. Bar grate 5' rests, at one end, on cross-member 7'. The other end, when inserted as shown in FIG. 1, is supported on support 8'. Support 8' is, preferably, provided on rail 9' (extending into the drawing in FIG. 1). Rail 9' is mounted at its opposite ends on piston rods 10' of pneumatic or hydraulic cylinders 11'. As a result of the extension of piston rods 10' out of pneumatic cylinders 11', it is possible for rail 9', along with support 8', to be moved to the right into the position shown by the dash-dotted line in FIG. 1. In this position, it is possible, for example, without using the temporary storage apparatus, for a pallet (not shown) to be deposited on the delivery table and to be moved into its upper sheet accepting position without having the pallet, which projects beyond the maximum size of sheet, colliding with support 8'.

Pneumatic or hydraulic cylinders 11', on either side of the pile of sheets, are mounted on carriers 12', to which also cross-member 7' is attached. Carriers 12' are provided with guides 13' that are guided in rolling mounts 14'. As the height of temporary pile 6' increases, carrier 12' and, with it, bar grate 5' and temporary pile 6' can be vertically lowered.

Particularly in the case of thick sheet stock and at high machine speed, such lowering may be necessary for non-stop operation.

The operation of the afore-described sheet stacker will be described in detail with reference to FIGS. 1–4*f*. Sheets 1' conveyed in an overlapping manner, are conveyed by ejection rollers 14 and pressure rollers 15 at a predetermined conveying speed virtually as far as the stop on the stop board 49. The air emerging from slot-like nozzles (not shown) blows a film of air between the sheets, which enables the sheets to slide over one another. The separation of the individual sheets and the rapid pressing down of the individual sheets onto pile or stack 46 takes place by means of the compressed air emerging in pulses from other nozzles (not shown). All air nozzles recited herein are well known to those of ordinary skill in the art and form no part of the present invention.

Figure 4A:
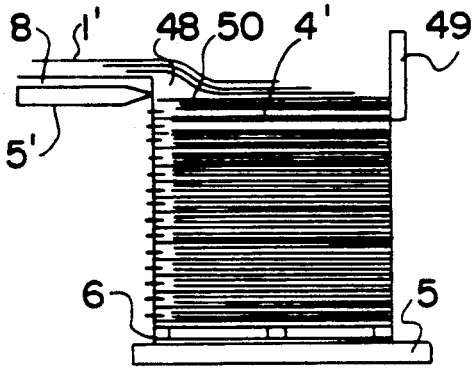
Figure 4D:
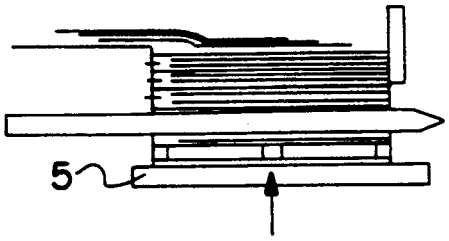
Figure 4E:
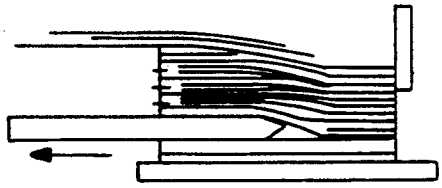
Figure 4B:
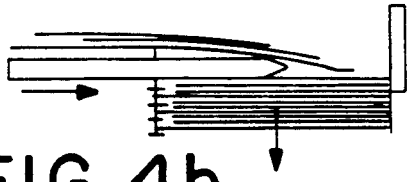
Figure 4F:
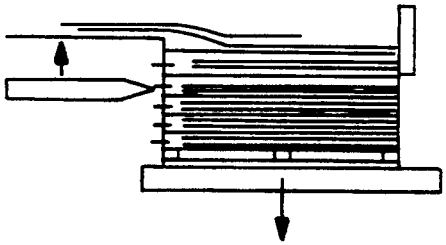
Figure 4C:
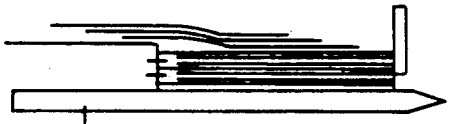

Upper level 50, of stack 41 lies a few centimeters below the conveying level (upper plane of table plate 7), to form gusset 48 which is freely accessible from the rear edges of the sheet. Level 50 lies at least below the upper side of bar grate, or bars 15' pointed at the front and as a rule, may lie even below bars 5' Since bars 5' in turn, reach virtually to the underside of the table plate 7, the small free height of gusset 48 is sufficient to be able to introduce bars 5' between overlapping sheets 1' and stack 4' During this operation, which is illustrated in FIG. 4*b*, stack 4' is lowered continuously. Bars 5' are lowered in synchronism therewith.

As soon as bars 5' are completely inserted and supported by their front ends on support 8' temporary pile 6' can be rapidly lowered and discharged. A new palette 6 is placed on table plate 5, which is then raised up below bars 5' Now bars 5' can again be withdrawn, in which case they are supported on palette 6 and their upper sliding belts prevent the lower sheet of the stack formed thereon in the meantime from being damaged. After palette 6 has entrained the new stack 4' and table plate 5 is lowered according to the supply of sheets, whereas bars 5' again travel into their upper initial position as shown in FIG. 4*a*.

Overlapping station 2, shown by conveyor belt 2*a*, transfer table 3 and sheet stacker 4 are illustrated one behind the other in the conveying direction of the overlapping sheets 1' in FIGS. 2–4*f*.

Figure 2:
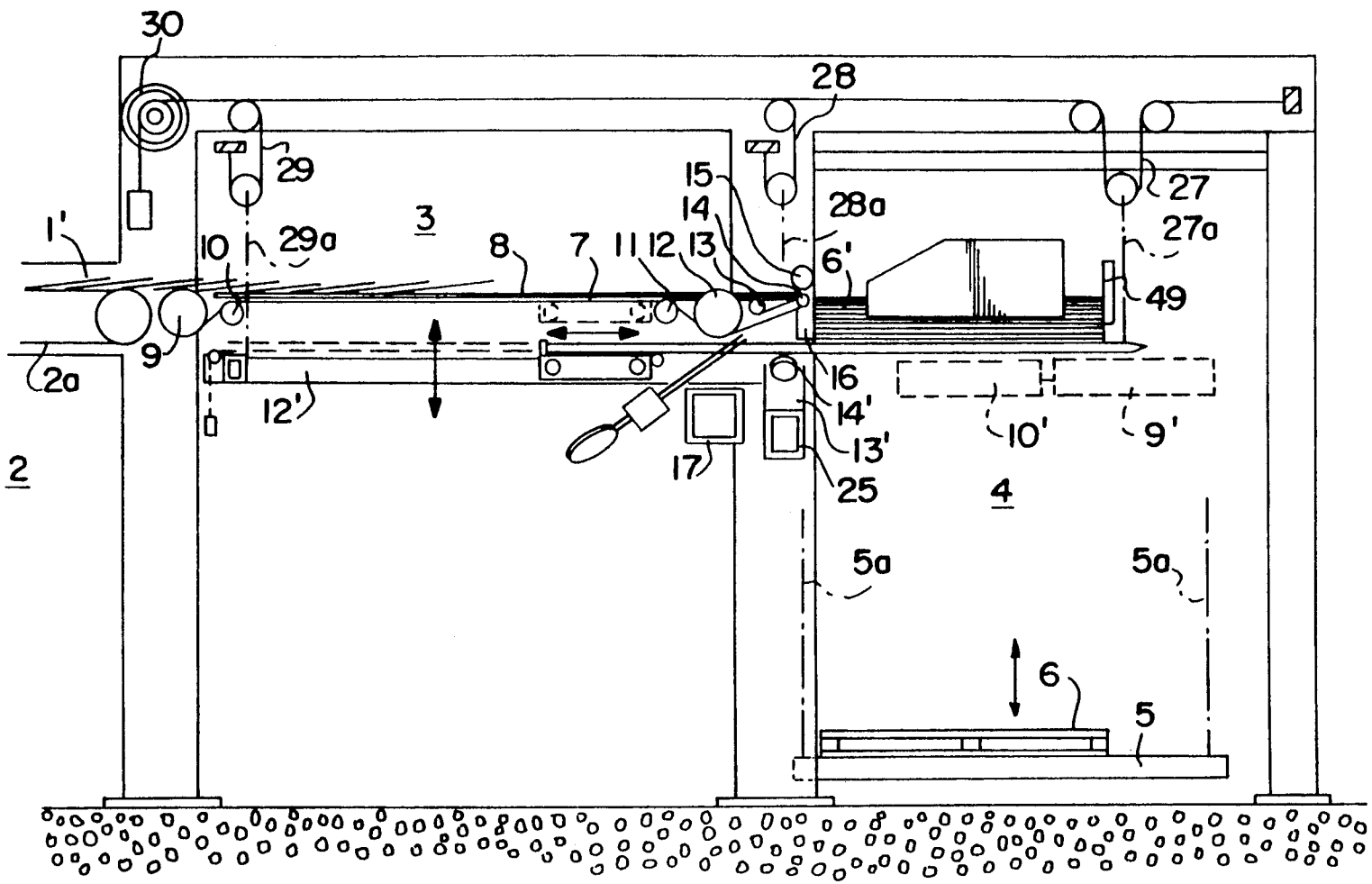
FIG. 2 is a side elevational view of the rotary printing press of FIG. 1 showing additional detail of the operation of the press.
Figure 3:
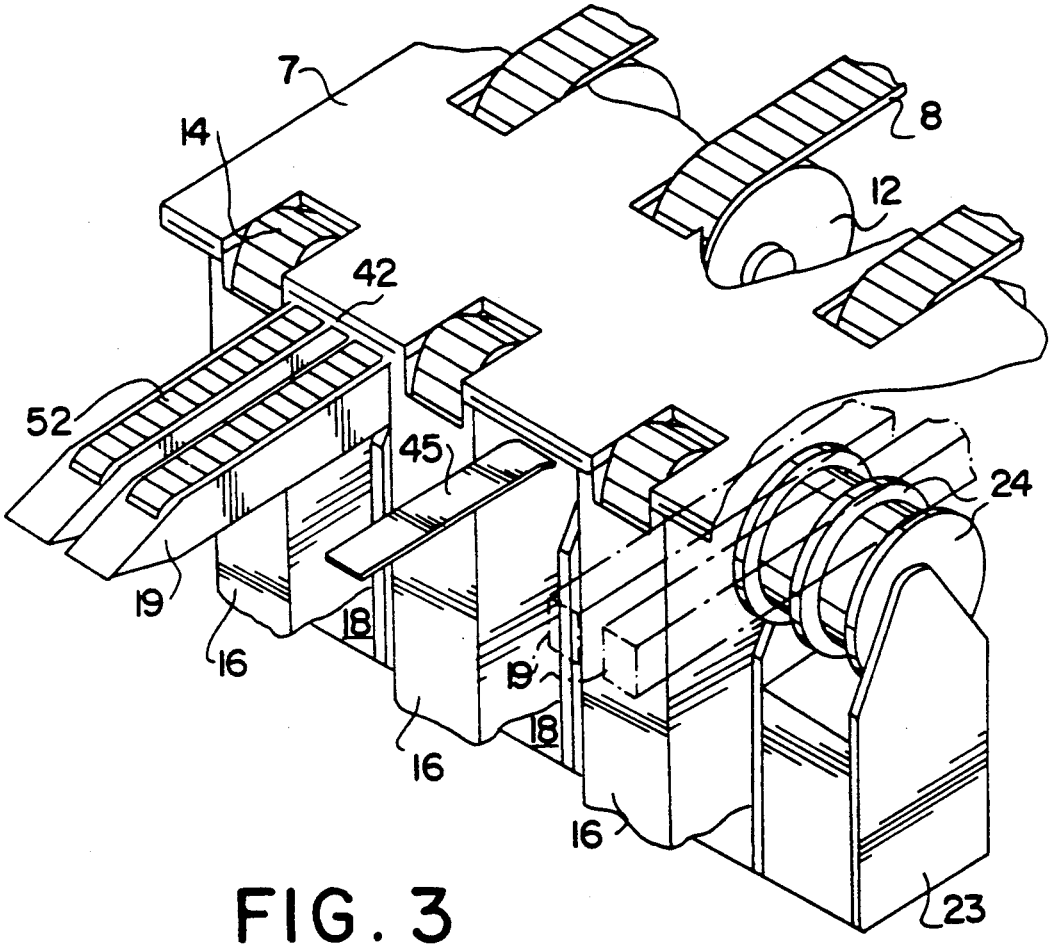
FIG. 3 is a perspective view of the bar grate support device of the rotary printing press of FIG. 1; and FIGS. *4a–4f* show the bar grate support device during various stages of operation.

Sheet stacker 4 consists of table 5, which can be raised and lowered and is suspended from ropes 5*a*, or the like, with palette 6 placed thereon for the stack of sheets. In the illustration of FIG. 2, the stack has just been changed and new palette 6 has been placed on table 5.

Transfer table 3 consists of a thin, smooth table plate 7, on the upper side of which the upper belts of several narrow conveyor belts 8 are supported. Belts 8 are guided over several conveying, tensioning, guide and ejection rollers 9–14 located below the conveying plane. Apart from rollers 9, all of the rollers 10–14 are free-running. Rollers 9 are driven. Roller 14, at the front edge of the table plate 7, serves as an ejection roller. Together with pressing roller 15, roller 14 ensures that the sheets are conveyed at a predetermined conveying speed as far as stacker 4. Rollers 9–14 are mounted on narrow uprights 16, which also support table plate 7, which are in turn supported on cross member 17. In the region of the front edge of table 7, bars 5' are supported on rolling mounts, or support track rollers 14' mounted in guides, or bearing blocks, 13'. Bearing blocks 13' are located on cross member 25. A support is provided for supporting the extended bars 19, on the side of stacker 4 opposite the front edge of table 7. Carrier, or guide, 12' and cross member 25 are suspended from ropes 27*a*, 28*a*, 29 of common lifting devices 27, 28, 29 which, by means of motor 30, allow the joint lowering and raising of guide 22 and of cross member 25.

By employing the present invention, and again with reference to FIG. 1, as the palette is raised towards bar grate 5', support 8' and rail 9' slide horizontally to the right thereby preventing the palette from striking this mechanism.

In summary, one feature of the invention resides broadly in a sheet delivery on rotary printing presses, in which the supplied sheets are deposited on a lowerable delivery table to form a pile of sheets, with a bar grate as temporary-pile apparatus, said bar grate being adapted to be slid in when there is a full pile of sheets and, when slid in, resting with its front free end on a support, characterized in that the support 8 is in the form of a rail 9, said rail 9 being held in such a manner that it is displaceable horizontally out of the area of the pile of sheets 4 by means of adjusting means.

Another feature of the invention resides broadly in a sheet delivery which characterized in that the adjusting means are disposed on either side of the rail 9 and are in the form of pneumatic cylinders 11 and in that the rail 9 is mounted on the piston rods 10 of the pneumatic cylinders 11.

Yet another feature of the invention resides broadly in a sheet delivery which is characterized in that the pneumatic cylinders 11 are mounted on carriers 12, said carriers 12 being lowerable as the height of the temporary pile 6 increases.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing press comprising:
sheet delivery means for delivering sheets of paper to the printing press;
adjustable support means for being positioned adjacent said sheet delivery means; and
receiving means for being positioned adjacent said sheet delivery means for receiving said delivered sheets and for accumulating the delivered sheets;
said adjustable support means for supporting a temporary storage means, said temporary storage means for the accumulation of said delivered sheets during the removal of accumulated sheets from said receiving means;
said adjustable support means comprising:
first support means for supporting a first end of said temporary storage means;
means for horizontally displacing said first support means in a first direction beyond the horizontal extension of said accumulated sheets;
said first support means comprising a single, non-rotatable structure; and
relative to said means for horizontally displacing said first support means, said first support means being displaceable solely along a horizontal direction.

2. The printing press according to claim 1, wherein said adjustable support means comprises means for vertically displacing at least a portion of said adjustable support means at least during the accumulation of said delivered sheets.

3. The printing press according to claim 2, wherein said single, non-rotatable structure comprises a rail member extending in a second direction, said second direction being substantially transverse to said first direction.

4. The printing press according to claim 3, wherein said means for horizontally displacing said first support means comprises at least one pneumatic cylinder having a horizontally extendible pneumatic piston.

5. The printing press according to claim 4, wherein said at least one pneumatic cylinder comprises two pneumatic cylinders, each of said two pneumatic cylinders has a horizontally extendible pneumatic piston, and said two horizontally extendible pneumatic pistons are connected adjacent the respective opposing ends of said rail member.

6. The printing press according to claim 1, wherein said temporary storage means comprises a plurality of bars.

7. The printing press according to claim 6, wherein:
said bars are horizontally displaceable between a first, retracted position and a second, extended position;
said bars are for being in said first, retracted position when said receiving means are receiving said delivered sheets; and
said bars are for receiving said delivered sheets when said bars are in said second, extended position.

8. The printing press according to claim 7, wherein:
said single rigid structure comprises a rail member and a support member; and
said rail member and said support member are integrated to form said single rigid structure.

9. The printing press according to claim 8, wherein:
said support member has a flat, horizontal surface;
each of said bars has a forward end;
said first end of said temporary storage means comprises said forward ends of said bars; and
said support member is configured to receive said forward ends of said bars on said flat, horizontal surface to support said bars when said bars are in said second, extended position.

10. The printing press according to claim 2, wherein said means for horizontally displacing said first support means comprises at least one hydraulic cylinder having a horizontally extendible hydraulic piston.

11. An adjustable support apparatus for being positioned adjacent the sheet delivery area of a printing press, said printing press being provided with receiving apparatus for receiving delivered sheets and for accumulating the delivered sheets, said adjustable support apparatus being for the support of a temporary storage member for the accumulation of the delivered sheets during the removal of accumulated sheets from the receiving apparatus, said adjustable support apparatus comprising:
first support means for supporting a first end of the temporary storage member;
means for horizontally displacing said first support member in a first direction beyond the horizontal extension of the accumulated sheets; and
means for vertically displacing a least a portion of said adjustable support apparatus at least during the accumulation of the delivered sheets.

12. The adjustable support apparatus according to claim 11, wherein:
said first support means comprises a single, non-rotatable structure; and
relative to said means for horizontally displacing said first support means, said first support means is displaceable solely along a horizontal direction.

13. The adjustable support apparatus according to claim 12, wherein said single, non-rotatable structure comprises a rail member extending in a second direction, said second direction being substantially transverse to said first direction.

14. The adjustable support apparatus according to claim 13, wherein said means for horizontally displacing said first support member comprises at least one pneumatic cylinder having a horizontally extendible pneumatic piston.

15. The adjustable support apparatus according to claim 14, wherein said at least one pneumatic cylinder comprises two pneumatic cylinders, each of said two pneumatic cylinders has a horizontally extendible pneumatic piston, and said two horizontally extendible pneumatic pistons are connected adjacent the respective opposing ends of said rail member.

16. The adjustable support apparatus according to claim 12, wherein said temporary storage means comprises a plurality of bars.

17. The printing press according to claim 16, wherein:

said bars are horizontally displaceable between a first, retracted position and a second, extended position;

said bars are for being in said first, retracted position when said receiving means are receiving said delivered sheets; and said bars are for receiving said delivered sheets when said bars are in said second, extended position.

18. The printing press according to claim 17, wherein:

said single, non-rotatable structure comprises a rail member and a support member; and said rail member and said support member are integrated to form said single, non-rotatable structure.

19. The printing press according to claim 18, wherein:

said support member has a flat, horizontal surface;

each of said bars has a forward end;

said first end of said temporary storage means comprises said forward ends of said bars; and said support member is configured to receive said forward ends of said bars on said flat, horizontal surface to support said bars when said bars are in said second, extended position.

20. The adjustable support apparatus according to claim 12, wherein said means for horizontally displacing said first support means comprises at least one hydraulic cylinder having a horizontally extendible hydraulic piston.

* * * * *

UNITED STATES PATENT AND TRADEMARK OFFICE

CERTIFICATE OF CORRECTION

PATENT NO. : 5,102,117

DATED : April 7, 1992

INVENTOR(S) : Manfred Henn and Carsten Kelm

It is certified that error appears in the above-indentified patent and that said Letters Patent is hereby corrected as shown below:

In column 2, line 62, after 'the' delete "arr," and insert --art,--.

In column 3, line 47, after 'stack' delete "41" and insert --4'--.

In column 3, line 51, after 'bars' delete " 15' " and insert --,5'--.

Signed and Sealed this

Twenty-seventh Day of August, 1996

Bruce Lehman

*Attest:*

BRUCE LEHMAN

*Attesting Officer*

*Commissioner of Patents and Trademarks*